209.13
6/29/82 XR 4,336,966 SR

United States Patent [19]

Ricketts

[11] 4,336,966

[45] Jun. 29, 1982

[54] CRATERING IN THE DEEP CRATERING REGION TO FORM AN IN SITU OIL SHALE RETORT

[75] Inventor: Thomas E. Ricketts, Grand Junction, Colo.

[73] Assignee: Occidental Oil Shale, Inc., Grand Junction, Colo.

[21] Appl. No.: 196,743

[22] Filed: Oct. 14, 1980

Related U.S. Application Data

[63] Continuation of Ser. No. 91,346, Nov. 5, 1979, abandoned.

[51] Int. Cl.[3] ..... E21B 43/247; E21B 43/263; E21C 41/10

[52] U.S. Cl. ..... 299/2; 166/259; 166/299; 299/13

[58] Field of Search ..... 166/256, 259, 299; 299/2, 13; 102/22, 23

[56] References Cited

U.S. PATENT DOCUMENTS

| | | | |
|---|---|---|---|
| 3,661,423 | 5/1972 | Garrett | 299/2 |
| 3,917,346 | 11/1975 | Janssen | 299/13 |
| 4,043,597 | 8/1977 | French | 299/2 |
| 4,043,598 | 8/1977 | French et al. | 299/2 |
| 4,118,071 | 10/1978 | Hutchins | 299/2 |
| 4,135,450 | 1/1979 | Lang | 299/13 X |

FOREIGN PATENT DOCUMENTS 1012564 7/1975 Canada .

OTHER PUBLICATIONS

Redpath, Bruce B., "Application of Cratering Characteristics to Conventional Blast Design", *Monograph I on Rock Mechanics Applications in Mining*, 1977.

Lang, L. C., "The Application of Spherical Charge Technology in Stope and Pillar Mining", *Engineering and Mining Journal*, May, 1976, pp. 98–101.

*Primary Examiner*—Stephen J. Novosad
*Assistant Examiner*—George A. Suchfield
*Attorney, Agent, or Firm*—Christie, Parker & Hale

[57] ABSTRACT

An in situ oil shale retort in a subterranean formation contains a fragmented permeable mass of formation particles. Such a fragmented mass is formed by excavating a horizontally extending void within the boundaries of the retort, leaving a zone of unfragmented formation above and/or below such a void. A plurality of vertical blasting holes are drilled in such a zone and loaded with explosive charges for forming an array of explosive charges sufficiently close together to interact and fragment formation substantially to a plane at the ends of the charges remote from the void. The scaled depth of burial of such an array is in the range of from about 6 to 12 mm/cal$^{1/3}$. The explosive charges are detonated in a single round for expanding such a zone towards the void for forming the fragmented mass of particles in the retort.

75 Claims, 4 Drawing Figures

CRATERING IN THE DEEP CRATERING REGION TO FORM AN IN SITU OIL SHALE RETORT

CROSS REFERENCE TO RELATED APPLICATIONS

This is a contination of application Ser. No. 091,346, filed Nov. 5, 1979, now abandoned.

BACKGROUND OF THE INVENTION

The presence of large deposits of oil shale in the Rocky Mountain region of the United States has given rise to extensive efforts to develop methods for recovering shale oil from kerogen in the oil shale deposits. It should be noted that the term "oil shale" as used in the industry is, in fact, a misnomer, it is neither shale nor does it contain oil, it is a sedimentary formation comprising marlstone deposit with layers containing an organic polymer called "kerogen" which, upon heating, decomposes to produce liquid and gaseous products. It is the formation containing kerogen that is called "oil shale" herein and the liquid hydrocarbon product is called "shale oil".

A number of methods have been proposed for processing oil shale which involve either first mining the kerogen-bearing shale and processing the shale on the ground surface or processing the shale in situ. The latter approach is preferable from the standpoint of environmental impact since the treated shale remains in place, reducing the chance of surface contamination and the requirement for disposal of solid wastes.

The recovery of liquid and gaseous products from oil shale deposits has been described in several patents such as U.S. Pat. Nos. 3,661,423; 4,043,597; and 4,043,598, as well as pending applications including U.S. Pat. Application Ser. No. 929,250, filed July 31, 1978, by Thomas E. Ricketts, now U.S. Pat. No. 4,192,554, and U.S. Patent Application Ser. No. 070,319 filed Aug. 27, 1979, by Chang Yul Cha, entitled TWO-LEVEL, HORIZONTAL FREE FACE MINING SYSTEM FOR IN SITU OIL SHALE RETORTS. Each of these applications and patents is assigned to Occidental Oil Shale, Inc., assignee of this application, and each is incorporated herein by this reference.

These patents and applications describe in situ recovery of liquid and gaseous hydrocarbon materials from a subterranean formation containing oil shale, wherein such formation is explosively expanded to form a stationary fragmented permeable mass of formation particles containing oil shale within the formation, referred to herein as an in situ oil shale retort, or merely as a retort. Retorting gases are passed through the fragmented mass to convert kerogen contained in the oil shale to liquid and gaseous products, thereby producing retorted oil shale. One method of supplying hot retorting gases used for converting kerogen contained in the oil shale as described in U.S. Pat. No. 3,661,423, includes establishing a combustion zone in the retort and introducing an oxygen-supplying retort inlet mixture into the retort to advance the combustion zone through the fragmented mass. In the combustion zone oxygen from the retort inlet mixture is depleted by reaction with hot carbonaceous materials to produce heat, combustion gas and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products, including gaseous and liquid hydrocarbons, and a residual carbonaceous material.

The liquid products and the gaseous products are cooled by the cooler oil shale fragments in the retort on the advancing side of the retorting zone. The liquid hydrocarbon products together with water produced in or added to the retort collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition and any gaseous retort inlet mixture that does not take part in the combustion process.

U.S. Pat. Nos. 4,043,597 and 4,043,598, and 4,192,554 discloses methods for explosively expanding formation containing oil shale toward horizontal free faces to form a fragmented mass in an in situ oil shale retort. According to such a method a plurality of vertically spaced apart voids of similar horizontal cross section are initially excavated one above another within the retort site. A plurality of vertically spaced apart zones of unfragmented formation are temporarily left between the voids. Explosive is placed in each of the unfragmented zones and detonated to explosively expand each unfragmented zone upwardly and/or downwardly towards the void or voids above and/or below it to form a fragmented mass having an average void volume about equal to the void volume of the initial voids. Retorting of the fragmented mass is then carried out to recover shale oil from the oil shale.

U.S. Patent Application Ser. No. 070,319 discloses a method for explosively expanding formation containing oil shale towards a horizontal free face to form a fragmented mass in an in situ oil shale retort. According to such a method, a void having a horizontal cross section similar to the horizontal cross section of the retort being formed is initially excavated. A plurality of vertically spaced apart zones of unfragmented formation are left above the void. Explosive is placed in each of the unfragmented zones and detonated for explosively expanding such zones towards the void to form a fragmented mass in the retort having an average void volume about equal to the void volume of the initial void. The overlying zones can be expanded towards the void in a single round or a plurality of rounds. Retorting of the fragmented mass is then carried out to recover shale oil from the oil shale.

It is desirable to have a generally uniformly distributed void fraction in the fragmented mass so that there is generally uniform permeability. Thus, oxygen supplying gas and combustion gas can flow reasonably uniformly through the fragmented mass during retorting operations. A fragmented mass having generally uniform permeability avoids bypassing portions of the fragmented mass by retorting gas as can occur if there is gas channelling through the mass due to non-uniform permeability. It is, therefore, desirable to provide a fragmented mass in a retort having reasonable uniformity of particle size and void fraction distribution.

BRIEF SUMMARY OF THE INVENTION

There is, therefore, provided in practice of this invention according to a presently preferred embodiment a method for forming an in situ oil shale retort in a subterranean formation containing oil shale. The retort contains a fragmented permeable mass of formation particles. At least one horizontally extending void is excavated within the retort site leaving a zone of unfragmented formation above and/or below such a void. A plurality of vertical blasting holes are drilled in such a zone and loaded with explosive charges. The charges form an array having a ratio of spacing distance to burden distance sufficiently small that the charges interact sufficiently to fragment the zone, substantially to a plane at the ends of the charges remote from the void. Detonation of these charges explosively expands such a zone towards the void for forming the fragmented permeable mass of formation particles in the retort. The scaled depth of burial of the array of explosive charges is preferably in the range of from about 6 to 12 $mm/cal^{1/3}$.

DRAWINGS

These and other features and advantages of the present invention will be appreciated as the same becomes better understood by reference to the following detailed description when considered in connection with the accompanying drawings wherein.

DESCRIPTION

Figure 1:
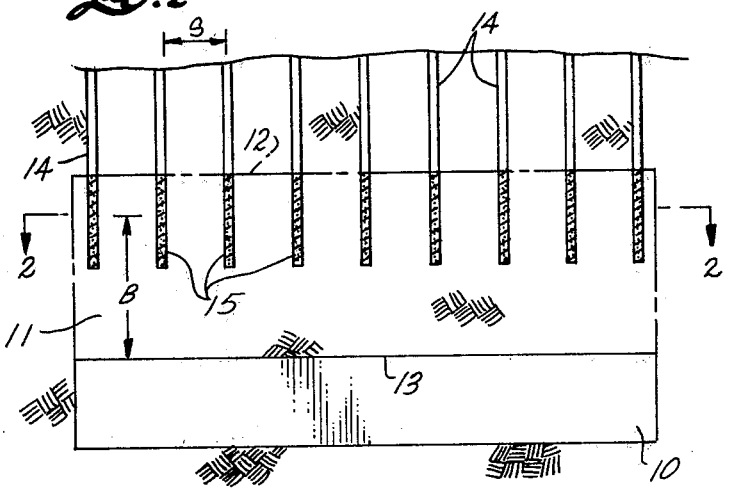
FIG. 1 is a fragmentary semi-schematic vertical cross section of an arrangement for forming an in situ oil shale retort.
Figure 2:
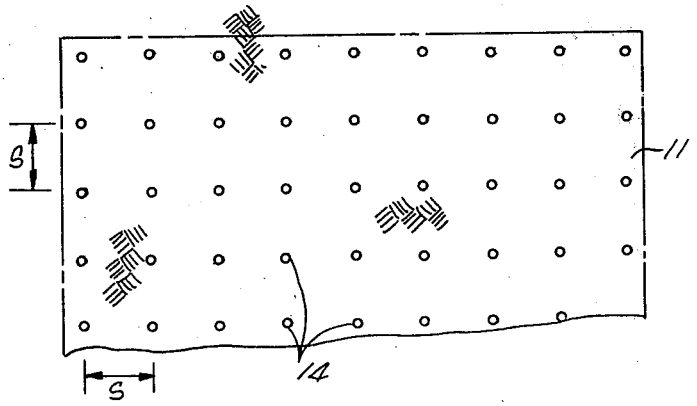
FIG. 2 is a fragmentary horizontal cross section through the retort site of FIG. 1.

FIGS. 1 and 2 are fragmentary views in vertical and horizontal cross section, respectively, of an in situ oil shale retort site at an intermediate stage during formation of the retort. As illustrated therein a horizontally extending void 10 is excavated in a subterranean formation, leaving a zone 11 of unfragmented formation immediately above the void as indicated by a phantom line 12. In an exemplary practice of this invention the zone 11 of unfragmented formation is explosively expanded towards the free face 13 at the top of the void 10. A plurality of blasting holes 14 are drilled into the zone and are loaded with explosive charges 15. Detonation of the explosive charges explosively expands the zone of unfragmented formation towards the void.

This application concerns an arrangement of explosive charges for such expansion and the fragmentary drawings suffice for a description of the method. It will be understood that the principles are applicable to a variety of arrangements for forming an in situ shale retort such as described in greater detail in the aforementioned patents and applications.

Thus, for example, the zone of unfragmented formation can be below such a void instead of above it. Alternatively, zones of unfragmented formation both above and below such a void can be expanded towards the void either sequentially or simultaneously. In another embodiment vertically spaced apart horizontal voids can be excavated in the subterranean formation leaving a zone of unfragmented formation between the voids. Such a zone can be explosively expanded towards both the upper and lower voids. Alternatively a relatively larger void can be excavated and overlying formation explosively expanded downwardly towards that void in a sequence of zones explosively expanded in a single round or in a series of rounds. A variety of combinations and permutations of these alternatives can be practiced, and several are described and illustrated in the above-mentioned patents and applications.

It will also be appreciated by one skilled in the art that other variations can be involved during formation of a retort, such as inclusion of a temporary roof supporting pillar within the boundaries of the void 10. Explosive charges can be placed in such a pillar for detonation in advance of detonation of explosive charges in an adjacent zone, thereby removing the pillar a very short time before explosive expansion of formation towards the horizontal free face. No such pillar is illustrated in FIG. 1 for simplicity.

In FIG. 1 the blasting holes 14 are drilled downwardly into the overlying zone of formation. Such drilling can be from an overlying subterranean base of operation or from the ground surface. If desired, such blasting holes can be drilled upwardly from the void 10.

As indicated, in FIG. 2 the retort has a rectangular horizontal cross section. The cross section can be square or any other desired configuration. Many other variations will be apparent and need not be described in detail.

In the method described herein, the void 10 is a "limited void" with respect to the volume of formation to be explosively expanded towards that void. That is, the void has less available volume than would be required for free expansion of formation towards the void.

When an earth formation is explosively fragmented and expanded, it increases in bulk due to the void space in interstices between the particles. The maximum expansion of an oil shale formation into an unlimited void results in a fragmented mass having an average void fraction of about 35%; that is, about 35% of the total volume occupied by the fragmented mass is void space between the particles. The volume occupied by the fragmented mass is about 55% larger than the volume occupied by the original unfragmented formation after such unlimited or free expansion. This is sometimes referred to as a bulking factor of 55%.

A "limited void" is one where the void space available for explosive expansion is less than needed for free bulking of the formation expanded towards that void. Thus, if a void has an excavated volume less than about 35% of the total of the volume of the void plus the volume occupied by formation explosively expanded, it is necessarily a limited void. It has been found that factors in addition to total available void can make a void "limited" even though the total available void may appear sufficient for free bulking. Thus, the fragmented mass formed by explosive expansion may not expand to completely fill available void space and the average void fraction in the fragmented mass may be less than projected from the available void space.

Figure 3:
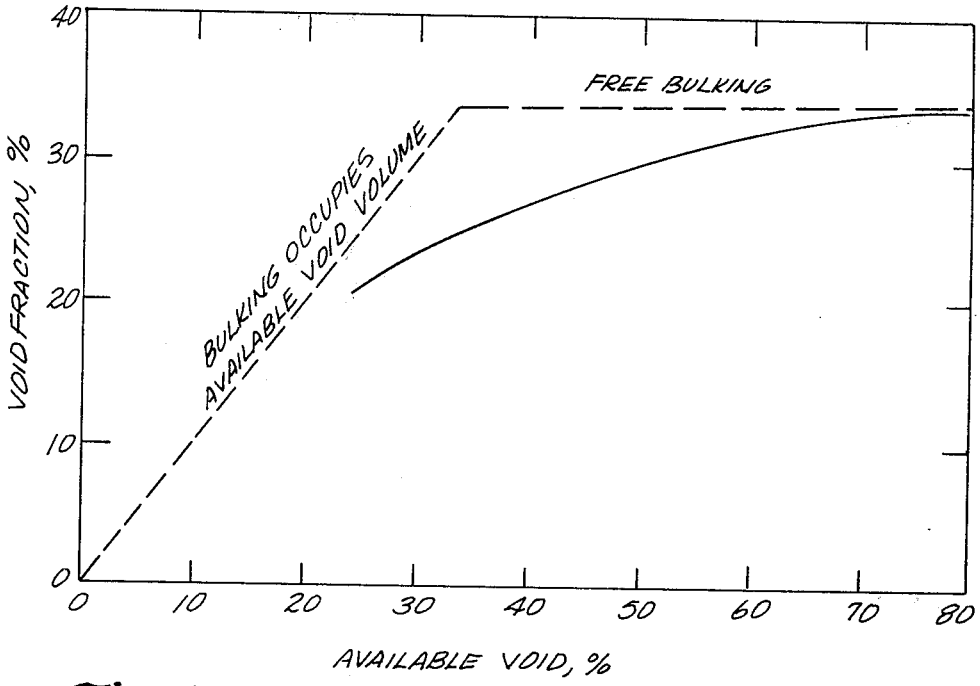
FIG. 3 is a graph of void fraction in a fragmented mass as a function of available void.

FIG. 3 is a graph of void fraction (in percent) in a fragmented mass as a function of the available void, also stated as a percentage. The available void is the percentage of the volume of an excavated void relative to the total volume of the excavated void plus the volume occupied by formation expanded towards that void.

One would expect the void fraction in a fragmented mass to equal the available void up to a void fraction corresponding to free bulking. Once the free bulking void fraction is reached there should be no increase in void fraction with increasing available void. Thus, if the available void were 28% for example, one would expect the void fraction in the fragmented mass to be 28%. If the available void were 40%, the void fraction would be expected to be 35%. This expectation is indicated by the dashed line in FIG. 3 which increases with a slope of one up to about 35% and above a void fraction of about 35% there is no increase regardless of increasing available void.

It has been found, however, that the actual void fraction in a fragmented mass is less than the available void up to available voids substantially above 35%. Thus, for example, with an available void of about 28%, the average void fraction in a fragmented mass was only about 23%. Similarly with an available void of about 55%, the fragmented mass void fraction was only about 31%. Such an experimentally determined relation is illustrated by the solid line in FIG. 3.

It is believed that an excavated void can behave as a limited void even though the available void is larger than required for free bulking because of interaction of particles during explosive expansion with adjacent walls of unfragmented formation. Thus, for example, formation expanding from the zone 11 can interact with the side walls of the void 10 or the opposite wall of unfragmented formation to inhibit free expansion, thereby limiting the actual void fraction obtained in the resulting fragmented mass. The same effect can occur when expanding formation collides with formation expanding from another direction, such as when zones both above and below a void are expanded.

It can be important when explosively expanding formation toward such a limited void to obtain as much bulking as feasible and minimize non-uniformity of void fraction in various regions of the fragmented mass. This tends to minimize pressure drop as gas flows through the fragmented mass and minimizes gas flow maldistribution. It is also desirable to minimize the amount of oil shale in large fragments since the time for retorting is increased and yield may be decreased. The arrangement of explosive charges for explosive expansion can assist in this regard.

Columnar explosive charges 15 are loaded into blasting holes in the unfragmented zone 11 with the axis of the charges extending perpendicular to the free face 13. Collectively, the explosive charges form an array with the centroids of the charges lying approximately in a plane parallel to the free face. The explosive charges are placed sufficiently close together that they interact upon detonation to assure fragmentation substantially to a plane at the ends of the explosive charges remote from the free face. In the embodiment illustrated in FIG. 1 the explosive charges are loaded so as to extend from approximately the middle of the zone of unfragmented formation to the boundary 12 remote from the horizontal free face 13. Above that boundary the blasting holes are stemmed with inert material; however, in an embodiment where an adjacent zone is also explosively expanded towards as overlying void explosive can extend beyond the upper boundary 12 as described in the aforementioned patents and applications.

It appears that explosive expansion of formation containing oil shale requires consideration of factors not considered in explosive expansion of other types of formation. It is conventionally considered that a stronger formation, i.e., one having a higher compressive strength requires more energy for explosive expansion than a weaker formation. An exception is very loosely consolidated formation which can also require high energy for explosive expansion. In oil shale formation the average grade or kerogen content of the oil shale has a significant influence on the energy and explosive distribution needed for good fragmentation and explosive expansion. Generally speaking, richer oil shale requires more energy than leaner oil shale. This is believed due to the high organic content of the rich shale and resulting plasticity or energy attenuation by such organic material in the formation.

The grade of oil shale is conventionally characterized by what is known as a Fischer assay rather than directly as kerogen content. This is a standard test in which a comminuted sample of oil shale is heated in a closed vessel at a standard rate. The quantity of shale oil extracted from the oil shale is measured. The Fischer assay or grade of oil shale is conventionally stated in units of gallons per ton, that is, gallons of shale oil recoverable from a ton of oil shale under the specified heating conditions. The actual yield of shale oil from a given formation can differ when retorting conditions are different from the Fischer assay. The Fischer assay, however, provides a standard for comparing oil shale formations.

As used in this specification, the term "lean oil shale" refers to oil shale having an average Fischer assay less than about 20 gallons per ton. For example, three in situ oil shale retorts have been constructed in formation containing oil shale wherein the fragmented mass in the retort had an average grade of 15.7, 16.1 and 19.3 gallons per ton, respectively. These retorts are considered to have been formed in lean oil shale. As used herein, the term "rich oil shale" refers to formation containing oil shale having an average grade over about 20 gallons per ton.

It will be recognized that oil shale is a lamellar formation having many deposition layers having different kerogen content or grade. Thus, in a formation, there can be layers completely devoid of organic material and other layers having a Fischer assay as high as 100 gallons per ton. Explosive expansion for forming a fragmented mass of particles in an in situ retort is not greatly influenced by such local variations in grade, and it is appropriate to consider the average grade of formation containing oil shale. For example, the average grade in zones about 30 to 50 feet thick can be appropriate for consideration of explosive expansion.

The ratio of the spacing distance S to burden distance B of the explosive charges for an array of cylindrical charges oriented perpendicular to the free face should be less than about one, and is preferably less than about $\simeq$ for lean oil shale. The ratio of S to B is preferably less than about $\frac{2}{3}$ for rich oil shale. The spacing distance is the distance S between adjacent blasting holes. In the illustrated pattern the array of charges is square, that is, the distance between adjacent charges in orthogonal directions is approximately the same. In some embodiments the charges can be in a rectangular array where the distance in one direction is somewhat longer than in the other direction, and in other embodiments a generally triangular arrangement can be employed with the charges in adjacent rows being staggered from each other. Average spacing distances are referred to in such embodiments.

The burden distance is the distance B between the free face and the centroid of the explosive charges.

When the ratio of spacing distance to burden distance is less than about one, interaction between adjacent explosive charges can occur to assure good fragmentation and fragmentation substantially to a plane at the ends of the blastholes remote from the free face. If the ratio of spacing distance to burden distance is greater than about one, good interaction may not be obtained. Preferably the spacing to burden ratio is less than about $\frac{7}{8}$ for lean oil shale and less than about $\frac{2}{3}$ for rich oil shale. Each blasting hole should contain sufficient explosive to assure interaction upon detonation. Preferably the scaled depth of burial of each explosive charge is about the same as the scaled depth of burial of the array of charges. With such an array, fragmentation substantially to a plane at the ends of the charges remote from the free face can be assured. Thus, for example, when the spacing to burden ratio is less than about $\frac{7}{8}$ for lean oil shale and less than about $\frac{2}{3}$ for rich oil shale, explosive expansion of the entire zone to the plane 13 can be assured. If the spacing to burden ratio is more than about $\frac{7}{8}$ in lean oil shale or more than about $\frac{2}{3}$ in rich oil shale, large particles of formation may result, with consequent impairment of effectiveness of retorting.

The scaled depth of burial of the array of explosive charges is preferably in the range of from about 6 to 12 $mm/cal^{1/3}$. The scaled depth of burial (sdob) is a useful relation for comparing blasting patterns having differing burden distance, explosive energy, and array geometries. Scaled depth of burial as it applies to cratering or explosive expansion towards a free face is described in a paper by Bruce B. Redpath, entitled "Application of Cratering Characteristics to Conventional Blast Design", a copy of which accompanies this application and which is incorporated herein by reference. Although the relations set forth are derived for an essentially infinite free face, the principles have been found applicable for explosive expansion towards a limited void.

The scaled point charge depth of burial (sdob) of an explosive charge can be expressed in units of distance over weight of explosive to the one-third power or preferably distance over energy of explosive to the one-third power. The sdob of a point charge, for example, is given by sdob equals $DOB/W^{1/3}$ where DOB is the actual depth of burial or burden of the charge from the free face and W is the weight of the charge. It is often preferable to state the sdob in terms of energy of explosive rather than weight, hence the units $mm/cal^{1/3}$. In the Redpath paper sdob is stated in terms of $ft/lb^{1/3}$ and this can be approximately converted to $mm/cal^{1/3}$ by multiplying by about four for a number of common types of explosive.

A scaled point charge depth of burial can be defined for each explosive charge in each blast hole and in addition an equivalent scaled point charge depth of burial can be defined for an array of explosive charges.

The same effective scaled depth of burial for an array of explosive charges can be obtained with a variety of patterns of blast holes. For example, the same effective scaled depth of burial of an array can be obtained with either (a) relatively more energetic explosive charges with relatively large spacing between holes, or (b) relatively less energetic explosive charges with relatively smaller spacing between holes.

The scaled depth of burial of an array of explosive charges can be altered by changing the amount of explosive in each blast hole, by changing the actual depth of burial of the explosive charge in each blasthole, by changing the diameter of each blasthole (hence the amount of explosive), by using a more or less energetic explosive in each blasthole, and/or by changing the array of blastholes so that they are spaced either closer or farther apart.

A relation similar to the sdob of a point charge can be written for a plane charge; that is, where the explosive charge is considered to form a plane substantially parallel to the free face and located in the unfragmented formation to be explosively expanded. The relation is $sdob_{pl}=DOB_{pl}/(w/s^2)$ where the subscript pl indicates a plane, $DOB_{pl}$ indicates the actual depth of burial of the plane and $w/s^2$ is the charge weight per unit area of such a plane explosive charge. In this equation the plane charge need not be continuous but can consist of separate cylindrical charges in blast holes of a blast hole array. It will be noted that $sdob_{pl}$ has the units of $(l^3/w)^1$ where l is a linear dimension and w is a charge weight. Thus, $sdob_{pl}$ is the inverse of a powder factor (PF) where powder factor is the weight of an explosive charge per unit volume of formation explosively expanded.

A useful equation relating scaled plane depth of burial to the equivalent scaled point charge depth of burial of the array is $$DOB_{pl}=sdob_{pt}\cdot(w/s^2)$$

This equation can be used in either of two ways: (a) given a blast array using cylindrical explosive charges, one can calculate directly $(w/s^2)$, actual $DOB_{pl}$ and the equivalent point charge $sdob_{pt}$ of the array of explosive charges, using the relation $sdob_{pt}-]DOB_{pl}/(w/s^2)]^{1/3}$; or (b) given a scaled point charge depth of burial that one wants to obtain using an array of cylindrical explosive charges, one can first determine $sdob_{pt}^3$ and then knowing the scale of the blast hole array that is practical for use (for example the depth of blast holes, size of blast holes, and type of explosive to be used), calculate $DOB_{pl}$ and W where W is the charge weight per unit hole. The required hole spacing or spacing distance S between cylindrical explosive charges to obtain the equivalent point charge can be calculated from $$S=]W\cdot sdob_{pt}^3/DOB_{pl}]^{1/2}$$

This equation is appropriate for a square array where S is the distance between adjacent blast holes as shown in FIG. 2. If an unequal rectangular array is used, the spacing between blastholes should be such that the product of the length of a side times the length of another side of such a rectangle is equal to the value of $s^2$.

Summarizing, the equivalent scaled point charge depth of burial of the entire array is thus $$sdob_{pt}=(DOB\cdot S^2)^{1/3}/W^{1/3}$$

where the actual array DOB is equal to the actual individual charge depth of burial, S is the spacing distance, and W is the charge weight per hole in the array.

Figure 4:
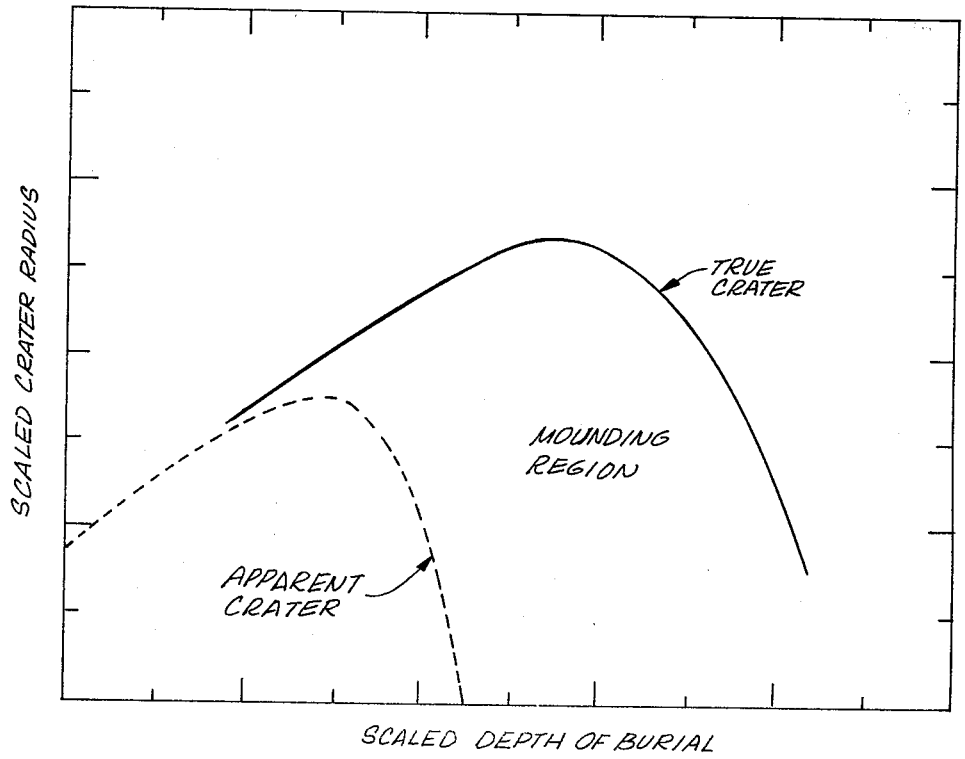
FIG. 4 is a representative cratering curve of scaled crater radius as a function of scaled depth of burial of explosive charges.

FIG. 4 is a graph of scaled crater radius as a function of scaled depth of burial for a point charge of explosive and is known as a cratering curve. Units have been omitted from this graph since the actual units will depend on a number of factors including properties of the formation being blasted and the explosive. The shape of the curves is representative although they may shift along the sdob axis for differing formations. The values of scaled crater radius and scaled depth of burial can be determined with a few small test blasts.

When a point charge is buried beneath a horizontal free face and detonated, some of the formation is fragmented and a generally cone-shaped crater is formed. Two types of crater should be distinguished. The boundary between unfragmented formation and fragmented formation is what is known as the true crater. The explosion can eject some of the fragmented formation laterally while other parts of the fragmented formation fall by gravity back into the true crater. The surface of the fragmented formation is known as the apparent crater. Since some of the formation falls back into the true crater, the apparent crater is ordinarily somewhat smaller than the true crater.

When a point charge of explosive has rather shallow burial, i.e., a small sdob, a small, somewhat flattened crater can result with most of the formation ejected so that the apparent crater is almost as large as the true crater. As the sdob is increased both the apparent crater and true crater radius (or volume) increase. The size of the apparent crater increases to a maximum and with further increase of sdob (e.g., by deeper burial of a fixed size of explosive charge) a smaller proportion of the fragmented formation is ejected laterally and the size of the apparent crater decreases. Eventually an sdob is reached where the size of the apparent crater becomes zero, since much of the ejecta falls back into the true crater. This relation is indicated by the dashed line in FIG. 4 which indicates the size of the apparent crater as a function of sdob.

The size of the true crater continues to increase as sdob is increased, and eventually reaches a maximum and thereafter decreases with increasing sdob. Eventually the sdob increases so much that the explosion cannot break to the free face and the explosion is completely contained. This relation is indicated by the solid line in FIG. 4 which indicates the size of the true crater as a function of sdob.

A region of the cratering curve, between the sdob where the apparent crater approaches zero and the sdob where the explosion is completely contained is known as the mounding region. In this range of sdob the fragmented formation completely fills the true crater and mounds above the original free face.

As used in this specification the term "deep cratering region" refers to the sdob between about the peak of the apparent crater curve and about the peak of the true crater curve. These peaks or maxima are somewhat approximate for a formation because in a "flat" part of the curves and because of scatter which appears to be inherent in blasting data.

The cratering curve illustrated in FIG. 4 is representative in shape. The details of such a curve differ somewhat based on properties of the earth formation. Thus, for example, in a formation containing lean oil shale in the Piceance Creek Basin in Western Colorado where the average Fischer assay of the formation is in the order of 15 gallons per ton, the maximum of the true crater curve occurs at an sdob of about 11 to 12 mm/cal$^{1/3}$. A formation containing rich oil shale having an average Fischer assay in the order of 30 gallons per ton has a maximum of the true crater curve at an sdob of about 8 mm/cal$^{1/3}$.

Although the cratering curve plots sdob of a point charge beneath a horizontal free face, its shape is applicable for other charge geometries although the curve may shift somewhat along the sdob axis. It will also be apparent that an array of explosive charges extending over an appreciable area will not produce a generally conical shaped crater as would a single point charge. The principles and numerical values of the sdob are, however, useful for forming an in situ oil shale retort.

As mentioned above, it is preferred to form a fragmented permeable mass of particles in an in situ oil shale retort by explosively expanding formation towards a horizontal free face with a plurality of explosive charges arranged in an array with the sdob of the array in the range of from about 6 to 12 mm/cal$^{1/3}$. It is found that if the sdob is more than about 12 mm/cal$^{1/3}$ when explosively expanding to a limited void, there may not be sufficient energy to properly explosively expand the formation with acceptable mixing and rotation of particles having an acceptable size distribution for efficient in situ oil shale retorting. Low void fraction regions and void fraction maldistribution may occur and the true crater may not be substantially at a plane at the ends of the explosive charges remote from the free face.

If the sdob of an array of explosive charges is less than about 6 mm/cal$^{1/3}$ when explosively expanding formation towards a limited void, the explosion may be too energetic and portions of the formation may be pulverized and overexpand, and reduce the volume available for expansion of other portions of the formation. Excessive explosive expansion may lead to void fraction maldistribution.

The properties of the oil shale have an influence on the preferable sdob of an array of explosive charges for expanding the oil shale. Preferably the sdob of the array is in the range of from about 6 to 9 mm/cal$^{1/3}$ for rich oil shale where high kerogen content attenuates energy and in the range of from about 9 to 12 mm/cal$^{1/3}$ for lean oil shale where kerogen content has a lesser influence. This assures adequate energy for explosive expansion without excessive pulverizing and bulking of the fragmented mass formed.

Preferably the sdob for an array of explosive charges for explosively expanding formation towards a horizontal free face for forming an in situ oil shale retort is in the mounting region or more preferably in the deep cratering region of the cratering curve for such oil shale formation. Blasting in this region when explosively expanding formation towards a limited void appears to give good fragmentation and particle rotation and mixing without significant void fraction maldistribution. Preferably explosive expansion employs an array having a sdob somewhat above the maximum of the apparent crater curve and up to about the maximum of the true crater curve. This promotes effective use of the explosive with good fragmentation and void fraction distribution.

It will be noted from the cratering curve that the same crater volume can be obtained for two volumes of sdob, one above the maximum of the true crater curve and one below the maximum of the true crater curve. It is preferred to select a smaller sdob for explosively expanding formation towards a limited void for forming a fragmented mass of particles in a retort. This more energetic blasting tends to yield a smaller particle size and the consequent greater burden velocity tends to yield greater bulking and lower average void fraction.

Most efficient use of explosive in terms of the quantity of formation broken is obtained near the peak of the true crater curve. This does not appear to be the only criterion, however, for explosively expanding formation towards a limited void for forming an in situ oil shale retort. Constraints imposed by side boundaries of unfragmented formation and interaction with opposing formation appear to inhibit the cratering process and do not allow full crater formation. Thus, when explosively expanding formation towards a limited void, it appears that the effective sdob is greater than calculated based on explosive expansion towards an unlimited void. This produces less bulking than would be expected. As a consequence arrays of explosive charges are selected having a smaller sdob to provide more energetic explosive expansion.

Specifically, it is preferred to employ an array of a plurality of explosive charges for explosively expanding oil shale towards a horizontal free face adjacent a limited void wherein the array has an sdob in the range of from about 9 to 12 mm/cal$^{1/3}$ where the formation containing oil shale has an average Fischer array in the order of 15 gallons per ton. It is also preferred to employ an array having an sdob in the range of from about 6 to 9 mm/cal$^{1/3}$ for forming a retort in a formation containing oil shale having an average grade in the order of 30 gallons per ton. The ranges of sdob are somewhat approximate and can also be influenced by other formation properties including average compressive strength, joint spacing and size, joint orientation, filling material in joints and fissures, in situ stress, consolidation of layers, water content and the like.

When the average grade of the formation containing oil shale is in the order of 15 gallons per ton, it is preferred that the sdob of the array of explosive charges be less than about 12 mm/cal$^{1/3}$, and when the average grade is in the order of 30 gallons per ton, the sdob is preferred to be less than 9 mm/cal$^{1/3}$. Larger values of sdob in these formations may give insufficient mixing and rotation of particles for forming a fragmented permeable mass in an in situ oil shale retort when explosively expanding formation towards a limited void with restraints on free expansion. It is preferred that the sdob of the array be more than about 6 mm/cal$^{1/3}$ for formation having an average Fischer array in the order of 15 gallons per ton, and more than about 9 mm/cal$^{1/3}$ for formation having an average grade in the order of 30 gallons per ton. Lower values of sdob for these formations may be too energetic, causing excessive pulverizing of formation and void fraction maldistribution, as well as wasting explosive and increasing drilling costs.

When the explosive charges are detonated the formation expands towards the adjacent void. The burden velocity of the formation depends on the sdob of the array of explosive charges. Burden velocity is the velocity of formation as it moves from the free face. If the burden velocity is too low, insufficient expansion may occur and the void fraction can be too low in some regions for good permeability. If the burden velocity is too high, the initial formation expanded can overexpand and occupy an excessive volume, leaving insufficient remaining void for complete and uniform expansion. It is, therefore, preferred that the burden velocity be in the range of from about 50 to 150 feet per second and more particularly about 75 to 125 feet per second. This range appears to give reasonably uniform permeability in the resulting fragmented mass.

Although specifically described with respect to expansion downwardly towards an underlying void with a square array of blasting holes, it will be apparent that many modifications and variations of this technique can be employed for forming an in situ oil shale retort, examples of which are suggested above.

For example, an in situ retort can be formed with plural voids and/or plural zones expanded upwardly and/or downwardly towards such a void and/or voids. In a retort having more than one zone to be explosively expanded it can occur that the grade of oil shale in such zones differs. It can be desirable in such a situation to use an array of explosive charges in each zone having an array scaled depth of burial suitable for the richest average grade of oil shale in any of such zones. This assures adequate energy for explosively exanding the richest zone and promotes uniformity of void fraction distribution when such zones are explosively expanded in a single round.

It is therefore to be understood that such variations are within the scope of this invention and should not be limited except as provided in the following claims.

What is claimed is:

1. A method for forming an in situ oil shale retort in a subterranean formation containing oil shale, the in situ oil shale retort containing a fragmented permeable mass of formation particles comprising the steps of:

excavating at least one horizontally extending void within the boundaries of the in situ oil shale retort site and leaving a zone of unfragmented formation above and/or below such a void;

drilling a plurality of blasting holes in at least one such zone of unfragmented formation;

loading explosive charges in such blasting holes for forming an array of explosive charges having a ratio of spacing distance to burden distance sufficiently small that said explosive charges can interact and fragment formation substantially to a plane at the portion of such charges remote from such void, and having an array scaled depth of burial in the range of from about 6 to 12 mm/cal$^{1/3}$; and detonating such explosive charges in a single round for explosively expanding such zone of unfragmented formation toward the void for forming a fragmented permeable mass of formation particles in the retort.

2. A method as recited in claim 1 wherein the void is a limited void relative to the zone of unfragmented formation expanded toward such a void.

3. A method as recited in either claim 1 or 2 wherein the scaled depth of burial of the array is in the mounding region of the cratering curve for the subterranean formation.

4. A method as recited in either claim 1 or 2 wherein the subterranean formation has an average Fischer assay in the order of 15 gallons per ton and the scaled depth of burial of the array is in the range of from about 9 to 12 mm/cal$^{1/3}$.

5. A method as recited in either claim 1 or 2 wherein the subterranean formation has an average Fischer assay in the order of 30 gallons per ton and the scaled depth of burial of the array is in the range of from about 6 to 9 mm/cal$^{1/3}$.

6. A method as recited in either claim 1 or 2 wherein the scaled depth of burial of the array is above about the maximum of the apparent crater curve and up to about the maximum of the true crater curve for the subterranean formation.

7. A method as recited in either claim 1 or 2 wherein the scaled depth of burial of the array is in the range of from about 6 to 9 mm/cal$^{1/3}$ for rich oil shale and in the range of from about 9 to 12 mm/cal$^{1/3}$ for lean oil shale.

8. A method as recited in claim 1 wherein the zone of unfragmented formation is above the void and is explosively expanded downwardly towards the void.

9. A method as recited in claim 8 also having a zone of unfragmented formation below such void and comprising drilling a plurality of vertically extending blasting holes in such zone of unfragmented formation below the void, loading explosive charges in such blasting holes for forming an array of explosive charges having a ratio of spacing distance to burden distance sufficiently small that such explosive charges interact and fragment formation substantially to a plane at the ends of the charges remote from the void and having an array scaled depth of burial in the range of from about 6 to 12 mm/cal$^{1/3}$, and detonating such explosive charges in a single round with the explosive charges in the zone above the void for explosively expanding such zones toward the void for forming a fragmented permeable mass of particles in the retort.

10. A method for forming an in situ shale retort in a subterranean formation containing oil shale, the in situ oil shale retort containing a fragmented permeable mass of formation particles containing oil shale comprising the steps of:

excavating at least one horizontally extending void within the boundaries of the in situ oil shale retort being formed and leaving a zone of unfragmented formation above and/or below such a void;

drilling a plurality of vertical blasting holes in such a zone of unfragmented formation;

loading explosive charges in such blasting holes for forming an array of explosive charges having a ratio of spacing distance to burden distance less than about one and sufficient explosive in each blasting hole to fragment formation substantially to a plane at the ends of such charges remote from the void, and an array scaled depth of burial in the range of from about 6 to 12 mm/cal$^{1/3}$; and detonating such explosive charges in a single round for explosively expanding such zone towards the void for forming a fragmented permeable mass of formation particles in the retort.

11. A method as recited in claim 10 wherein the subterranean formation has an average Fischer assay in the order of 30 gallons per ton and the scaled depth of burial of the array is in the range of from about 6 to 9 mm/cal$^{1/3}$.

12. A method as recited in claim 10 wherein the zone of unfragmented formation has an average Fischer assay of about 15 gallons per ton and the ratio of spacing distance to burden distance is less than about $\frac{7}{8}$.

13. A method as recited in claim 10 wherein the zone of unfragmented formation has an average Fischer assay in the order of 30 gallons per ton and the ratio of spacing distance to burden distance is less than about $\frac{2}{3}$.

14. A method as recited in either claim 12 or 13 wherein the explosive charges extend between about the middle of the zone of unfragmented formation and the boundary of the zone of unfragmented formation remote from the void.

15. A method as recited in claim 10 wherein the scaled depth of burial of the array is in the mounding region of the cratering curve for the subterranean formation.

16. A method as recited in claim 10 wherein the scaled depth of burial of the array is above about the maximum of the apparent crater curve and up to about the maximum of the true crater curve for the subterranean formation.

17. A method as recited in either claim 10 or 16 wherein the void is a limited void relative to the zone of unfragmented formation expanded toward the void.

18. A method as recited in claim 9 wherein the subterranean formation has an average Fischer assay in the order of 15 gallons per ton and the scaled depth of burial of the array is in the range of from about 9 to 12 mm/cal$^{1/3}$.

19. A method as recited in claim 10 wherein the scaled depth of burial of the array is in the range of from about 6 to 9 mm/cal$^{1/3}$ for rich oil shale and in the range of from about 9 to 12 mm/cal$^{1/3}$ for lean oil shale.

20. A method for forming an in situ oil shale retort in a subterranean formation containing oil shale, the subterranean formation having an average grade in the order of 30 gallons per ton, the in situ oil shale retort containing a fragmented permeable mass of formation particles comprising the steps of:

excavating at least one horizontally extending void within the boundaries of the in situ oil shale retort and leaving a zone of unfragmented formation above the void for explosive expansion toward the void, the void being a limited void relative to the volume of the zone of unfragmented formation to be explosively expanded toward the void;

drilling a plurality of vertical blasting holes into the zone of unfragmented formation;

loading explosive charges in such blasting holes for forming an array of explosive charges having a ratio of spacing distance to burden distance less than about one, and an array scaled depth of burial in the range of from about 6 to 9 mm/cal$^{1/3}$; and detonating such explosive charges in a single round for explosively expanding the zone of unfragmented formation downwardly toward the void for forming a fragmented permeable mass of formation particles in the retort.

21. A method for forming an in situ oil shale retort in a subterranean formation containing oil shale, the subterranean formation having an average grade in the order of 15 gallons per ton, the in situ oil shale retort containing a fragmented permeable mass of formation particles, comprising the steps of:

excavating at least one horizontally extending void within the boundaries of the in situ oil shale retort and leaving a zone of unfragmented formation above the void for explosive expansion toward the void, the void being a limited void relative to the volume of the zone of unfragmented formation to be explosively expanded toward the void;

drilling a plurality of vertical blasting holes into the zone of unfragmented formation;

loading explosive charges in such blasting holes for forming an array of explosive charges having a ratio of spacing distance to burden distance less than about one, and an array scaled depth of burial in the range of from about 9 to 12 mm/cal$^{1/3}$; and detonating such explosive charges in a single round for explosively expanding the zone of unfragmented formation downwardly toward the void for forming a fragmented permeable mass of formation particles in the retort.

22. A method as recited in either claim 20 or 21 wherein the scaled depth of burial of the array is in the deep cratering region of the cratering curve for the subterranean formation.

23. A method for forming an in situ oil shale retort in a subterranean formation containing oil shale, the in situ oil shale retort containing a fragmented permeable mass of formation particles containing oil shale, comprising the steps of:

excavating at least one void within the boundaries of the in situ oil shale retort being formed and leaving a zone of unfragmented formation adjacent such a void, defining a free face adjacent the void;

placing a plurality of columnar explosive charges in such a zone perpendicular to the free face, the explosive charges having a ratio of spacing distance to burden distance sufficiently low that the explosive charges interact and fragment formation substantially to a plane at about the end of the charges remote from the free face, and having an array scaled depth of burial in the range of from about 6 to 12 mm/cal$^{1/3}$; and detonating such explosive charges in a single round for explosively expanding such zone towards the void for forming a fragmented permeable mass of formation particles in the retort.

24. A method as recited in claim 23 wherein the subterranean formation comprises rich oil shale and the scaled depth of burial of the array is in the range of from about 6 to 9 mm/cal$^{1/3}$.

25. A method as recited in claim 23 wherein the subterranean formation comprises lean oil shale and the scaled depth of burial of the array is in the range of from about 9 to 12 mm/cal$^{1/3}$.

26. A method as recited in claim 23 wherein the scaled depth of burial of the array is in the mounding region of the cratering curve for the subterranean formation.

27. A method as recited in claim 23 wherein the explosive charges extend between about the middle of the zone of unfragmented formation and the boundary of the zone of unfragmented formation remote from the void.

28. A method as recited in claim 23 wherein the zone of unfragmented formation is above the void and is explosively expanded downwardly towards the void.

29. A method as recited in claim 23 wherein the scaled depth of burial of the array is in the deep cratering region of the cratering curve for the subterranean formation.

30. A method as recited in claim 23 wherein the scaled depth of burial of the array is in the range of from about 6 to 9 mm/cal$^{1/3}$ for rich oil shale and in the range of from about 9 to 12 mm/cal$^{1/3}$ for lean oil shale.

31. A method for forming an in situ oil shale retort in a subterranean formation containing oil shale, the in situ oil shale retort containing a fragmented permeable mass of formation particles, comprising the steps of:

excavating at least one horizontally extending void within the boundaries of the in situ oil shale retort and leaving a zone of unfragmented formation above the void for explosive expansion toward the void, the void being a limited void relative to the volume of the zone of unfragmented formation to be explosively expanded toward the void;

drilling a plurality of vertical blasting holes into the zone of unfragmented formation;

loading explosive charges in such blasting holes for forming an array of explosive charges having a ratio of spacing distance to burden distance less than about one and sufficient explosive in each blasting hole to fragment formation substantially to a plane at the ends of such charges remote from the void, and an array scaled depth of burial above about the maximum of the apparent crater curve and up to about the maximum of the true crater curve for the subterranean formation;

detonating such explosive charges in a single round for explosively expanding the zone of unfragmented formation downwardly toward the void for forming a fragmented permeable mass of formation particles in the retort.

32. A method for forming an in situ oil shale retort in a subterranean formation containing oil shale, the in situ oil shale retort containing a fragmented permeable mass of formation particles, comprising the steps of:

excavating at least one horizontally extending void within the boundaries of the in situ oil shale retort and leaving a zone of unfragmented formation above the void for explosive expansion toward the void, the void being a limited void relative to the volume of the zone of unfragmented formation to be explosively expanded toward the void;

drilling a plurality of vertical blasting holes into the zone of unfragmented formation;

loading explosive charges in such blasting holes for forming an array of explosive charges having a ratio of spacing distance to burden distance less than about one and sufficient explosive in each blasting hole to fragment formation substantially to a plane at the ends of such charges remote from the void, and an array scaled depth of burial in the mounding region of the cratering curve for the subterranean formation; and detonating such explosive charges in a single round for explosively expanding the zone of unfragmented formation downwardly toward the void for forming a fragmented permeable mass of formation particles in the retort.

33. A method for forming an in situ oil shale retort in a subterranean formation containing oil shale, the in situ oil shale retort containing a fragmented permeable mass of formation particles containing oil shale, comprising the steps of:

excavating at least one void within the boundaries of the in situ oil shale retort being formed and leaving a zone of unfragmented formation adjacent such a void defining a free face adjacent the void;

placing a plurality of columnar explosive charges in such a zone perpendicular to the free face, the explosive charges having a ratio of spacing distance to burden distance less than about $\frac{7}{8}$ and sufficient explosive in each blasting hole to fragment formation substantially to a plane at the ends of such charges remote from the void, and an array scaled depth of burial above about the maximum of the apparent crater curve and up to about the maximum of the true crater curve for the subterranean formation; and detonating such explosive charges in a single round for explosively expanding such zone towards the void for forming a fragmented permeable mass of formation particles in the retort.

34. A method as recited in claim 33 wherein the void is a limited void relative to the zone of unfragmented formation expanded toward such a void.

35. A method as recited in claim 33 wherein the zone of unfragmented formation is above the void and is explosively expanded downwardly towards the void.

36. A method as recited in claim 33 wherein the zone has an average Fischer assay in the order of 30 gallons per ton and the ratio of spacing distance to burden distance is less than about $\frac{2}{3}$.

37. A method as recited in either claim 34 or 36 wherein the explosive charges extend between about the middle of the zone of unfragmented formation and the boundary of the zone of unfragmented formation remote from the void.

38. A method for forming an in situ oil shale retort in a subterranean formation containing oil shale, the in situ oil shale retort containing a fragmented permeable mass of formation particles containing oil shale, comprising the steps of:

excavating at least one void within the boundaries of the in situ oil shale retort being formed and leaving a zone of unfragmented formation adjacent such a void defining a free face adjacent the void;

placing a plurality of columnar explosive charges in such a zone perpendicular to the free face, the explosive charges having a ratio of spacing distance to burden distance less than about $\frac{7}{8}$ and sufficient explosive in each blasting hole to fragment formation substantially to a plane at the ends of such charges remote from the void, and having an array scaled depth of burial in the mounding region of the cratering curve for the formation; and detonating such explosive charges in a single round for explosively expanding such zone towards the void for forming a fragmented permeable mass of formation particles in the retort.

39. A method as recited in claim 38 wherein the void is a limited void relative to the zone of unfragmented formation expanded toward such a void.

40. A method as recited in claim 38 wherein the zone has an average Fischer assay in the order of 30 gallons per ton and the ratio of spacing distance to burden distance is less than about $\frac{2}{3}$.

41. A method as recited in claim 38 wherein the explosive charges extend between about the middle of the zone of unfragmented formation and the boundary of the zone of unfragmented formation remote from the void.

42. A method for forming an in situ oil shale retort in a subterranean formation containing oil shale, the in situ oil shale retort containing a fragmented permeable mass of formation particles comprising the steps of:

excavating at least one horizontally extending void within the boundaries of the in situ oil shale retort site and leaving a zone of unfragmented formation above and/or below such a void;

drilling a plurality of blasting holes in at least one such zone of unfragmented formation;

loading explosive charges in such blasting holes for forming an array of explosive charges having a ratio of spacing distance to burden distance sufficiently small that said explosive charges can interact and fragment formation substantially to a plane at the portion of such charges remote from such void, and having an array scaled depth of burial in the mounding region of the cratering curve for the formation; and detonating such explosive charges in a single round for explosively expanding such zone of unfragmented formation toward the void for forming a fragmented permeable mass of formation particles in the retort.

43. A method for forming an in situ oil shale retort in a subterranean formation containing oil shale, the in situ oil shale retort containing a fragmented permeable mass of formation particles comprising the steps of:

excavating at least one horizontally extending void within the boundaries of the in situ oil shale retort site and leaving a zone of unfragmented formation above and/or below such a void;

drilling a plurality of blasting holes in at least one such zone of unfragmented formation;

loading explosive charges in such blasting holes for forming an array of explosive charges having a ratio of spacing distance to burden distance sufficiently small that said explosive charges can interact and fragment formation substantially to a plane at the portion of such charges remote from such void, and having an array scaled depth of burial above about the maximum of the apparent crater curve and up to about the maximum of the true crater curve for the formation; and detonating such explosive charges in a single round for explosively expanding such zone of unfragmented formation toward the void for forming a fragmented permeable mass of formation particles in the retort.

44. A method as recited in claim 43 wherein the zone of unfragmented formation is above the void and is explosively expanded downwardly towards the void.

45. A method for forming an in situ oil shale retort in a subterranean formation containing oil shale, the in situ oil shale retort containing a fragmented permeable mass of formation particles comprising the steps of:

excavating at least one horizontally extending void within the boundaries of the in situ oil shale retort site and leaving a zone of unfragmented formation above and/or below such a void, the void being a limited void relative to the zone of unfragmented formation;

drilling a plurality of blasting holes in at least one such zone of unfragmented formation;

loading explosive charges in such blasting holes for forming an array of explosive charges having a ratio of spacing distance to burden distance sufficiently small that said explosive charges can interact and fragment formation substantially to a plane at the portion of such charges remote from such void, and having an array scaled depth of burial sufficient to give a burden velocity of expanding formation in the range of from about 75 to 125 feet per second; and detonating such explosive charges in a single round for explosively expanding such zone of unfragmented formation toward the void for forming a fragmented permeable mass of formation particles in the retort.

46. A method as recited in claim 45 wherein the zone of unfragmented formation is above the void and is explosively expanded downwardly towards the void.

47. A method for forming an in situ oil shale retort in a subterranean formation containing oil shale, the in situ oil shale retort containing a fragmented permeable mass of formation particles containing oil shale, comprising the steps of:

excavating at least one void within the boundaries of the in situ oil shale retort being formed and leaving a zone of unfragmented formation adjacent such a void, defining a free face adjacent the void;

placing a plurality of columnar explosive charges in such a zone perpendicular to the free face, the explosive charges having a ratio of spacing distance to burden distance sufficiently low that the explosive charges interact and fragment formation substantially to a plane at about the end of the charges remote from the free face, and having an array scaled depth of burial sufficient to give a burden velocity of expanding formation in the range of from about 75 to 125 feet per second; and detonating such explosive charges in a single round for explosively expanding such zone towards the void for forming a fragmented permeable mass of formation particles in the retort.

48. A method as recited in claim 47 wherein the void is a limited void relative to the zone of unfragmented formation expanded toward such a void.

49. A method as recited in claim 47 wherein the zone of unfragmented formation has an average Fischer assay in the order of 30 gallons per ton and the scaled depth of burial of the array is in the range of from about 6 to 9 mm/cal$^{1/3}$.

50. A method as recited in claim 47 wherein the scaled depth of burial of the array is in the range of from about 6 to 9 mm/cal$^{1/3}$ for rich oil shale and in the range of from about 9 to 12 mm/cal$^{1/3}$ for lean oil shale.

51. A method for forming an in situ oil shale retort in a subterranean formation containing oil shale, the in situ oil shale retort containing a fragmented permeable mass of formation particles containing oil shale, comprising the steps of:

excavating at least one void within the boundaries of the in situ oil shale retort being formed and leaving a zone of unfragmented formation adjacent such a void defining a free face adjacent the void, the zone having an average Fischer assay in the order of 30 gallons per ton;

placing a plurality of explosive charges in such a zone, the explosive charges having a ratio of spacing distance to burden distance sufficiently low that the explosive charges interact and fragment formation substantially to a plane at about the portion of the charges most remote from the free face, and having an array scaled depth of burial in the range of from about 6 to 9 mm/cal$^{1/3}$; and detonating such explosive charges in a single round for explosively expanding such zone towards the void for forming a fragmented permeable mass of formation particles in the retort.

52. A method for forming an in situ oil shale retort in a subterranean formation containing lean oil shale, the in situ oil shale retort containing a fragmented permeable mass of formation particles comprising the steps of:

excavating at least one horizontally extending void within the boundaries of the in situ oil shale retort and leaving a zone of unfragmented formation above and/or below the void for explosive expansion toward the void, the void being a limited void relative to the volume of unfragmented formation to be explosively expanded toward the void;

drilling a plurality of vertical blasting holes into such a zone of unfragmented formation;

loading explosive charges in such blasting holes for forming an array of explosive charges having a ratio of spacing distance to burden distance less than about one, and an array scaled depth of burial in the range of from about 9 to 12 mm/cal$^{1/3}$; and detonating such explosive charges in a single round for explosively expanding the zone of unfragmented formation toward the void for forming a fragmented permeable mass of formation particles in the retort.

53. A method for forming an in situ oil shale retort in a subterranean formation containing oil shale, the in situ oil shale retort containing a fragmented permeable mass of formation particles comprising the steps of:

excavating at least one void within the boundaries of the in situ oil shale retort site and leaving a zone of unfragmented formation above such a void having a horizontally extending free face over the void;

drilling a plurality of blasting holes in the zone of unfragmented formation;

loading explosive charges in such blasting holes for forming an array of explosive charges having a ratio of spacing distance to burden distance sufficiently small that said explosive charges can interact and fragment formation substantially to a plane at the portion of such charges remote from such void, and having an array scaled depth of burial in the range of from about 6 to 12 mm/cal$^{1/3}$; and detonating such explosive charges for explosively expanding such zone of unfragmented formation toward the void for forming a fragmented permeable mass of formation particles in the retort.

54. A method as recited in claim 53 wherein the subterranean formation has an average Fischer assay more than 20 gallons per ton and the scaled depth of burial of the array is in the range of from about 6 to 9 mm/cal$^{1/3}$.

55. A method for forming an in situ oil shale retort in a subterranean formation containing oil shale, the in situ oil shale retort containing a fragmented permeable mass of formation particles containing oil shale comprising the steps of:

excavating at least one void within the boundaries of the in situ oil shale retort being formed and leaving a zone of unfragmented formation above such a void having a horizontally extending free face over the void;

drilling a plurality of vertical blasting holes in the zone of unfragmented formation;

loading explosive charges in such blasting holes for forming an array of explosive charges having a ratio of spacing distance to burden distance less than about one and sufficient explosive in each blasting hole to fragment formation substantially to a plane at the ends of such charges remote from the void, and an array scaled depth of burial in the range of from about 6 to 12 mm/cal$^{1/3}$; and detonating such explosive charges for explosively expanding such zone towards the void for forming a fragmented permeable mass of formation particles in the retort.

56. A method as recited in claim 55 wherein the subterranean formation has an average Fischer assay more than 20 gallons per ton and the scaled depth of burial of the array is in the range of from about 6 to 9 mm/cal$^{1/3}$.

57. A method as recited in claim 56 wherein the zone of unfragmented formation has an average Fischer assay in the order of 30 gallons per ton and the ratio of spacing distance to burden distance is less than about $\frac{2}{3}$.

58. A method as recited in claim 55 wherein the scaled depth of burial of the array is above about the maximum of the apparent crater curve and up to about the maximum of the true crater curve for the subterranean formation.

59. A method as recited in claim 55 wherein the void is a limited void relative to the zone of unfragmented formation expanded toward the void.

60. A method for forming an in situ oil shale retort in a subterranean formation containing oil shale, the subterranean formation having an average grade more than 20 gallons per ton, the in situ oil shale retort containing a fragmented permeable mass of formation particles comprising the steps of:

excavating at least one void within the boundaries of the in situ oil shale retort and leaving a zone of unfragmented formation above the void for explosive expansion toward the void, the zone of unfragmented formation having a horizontally extending free face over the void, the void being a limited void relative to the volume of the zone of unfragmented formation to be explosively expanded toward the void;

drilling a plurality of vertical blasting holes into the zone of unfragmented formation;

loading explosive charges in such blasting holes for forming an array of explosive charges having a ratio of spacing distance to burden distance less than about one, and an array scaled depth of burial in the deep cratering region of the cratering curve for the subterranean formation; and detonating such explosive charges for explosively expanding the zone of unfragmented formation downwardly toward the void for forming a fragmented permeable mass of formation particles in the retort.

61. A method as recited in claim 60 wherein the scaled depth of burial of the array is in the range of from about 6 to 9 mm/cal$^{1/3}$.

62. A method for forming an in situ oil shale retort in a subterranean formation containing oil shale, the in situ oil shale retort containing a fragmented permeable mass of formation particles, comprising the steps of:

excavating at least one void within the boundaries of the in situ oil shale retort and leaving a zone of unfragmented formation above the void for explosive expansion toward the void, the zone of unfragmented formation having a free face over the void;

drilling a plurality of vertical blasting holes into the zone of unfragmented formation;

loading explosive charges in such blasting holes for forming an array of explosive charges having a ratio of spacing distance to burden distance less that about one and sufficient explosive in each blasting hole to fragment formation substantially to a plane at the ends of such charges remote from the void, and an array scaled depth of burial above about the maximum of the apparent crater curve and up to about the maximum of the true crater curve for the subterranean formation;

detonating such explosive charges for explosively expanding the zone of unfragmented formation downwardly toward the void for forming a fragmented permeable mass of formation particles in the retort.

63. A method for forming an in situ oil shale retort in a subterranean formation containing oil shale, the in situ oil shale retort containing a fragmented permeable mass of formation particles, comprising the steps of:

excavating at least one void within the boundaries of the in situ oil shale retort and leaving a zone of unfragmented formation above the void for explosive expansion toward the void, the zone of unfragmented formation having a horizontally extending free face over the void;

drilling a plurality of vertical blasting holes into the zone of unfragmented formation;

loading explosive charges in such blasting holes for forming an array of explosive charges having a ratio of spacing distance to burden distance less than about one and sufficient explosive in each blasting hole to fragment formation substantially to a plane at the ends of such charges remote from the void; and an array scaled depth of burial in the mounding region of the cratering curve for the subterranean formation; and detonating such explosive charges for explosively expanding the zone of unfragmented formation downwardly toward the void for forming a fragmented permeable mass of formation particles in the retort.

64. A method as recited in claim 63 wherein the void is a limited void relative to the zone of unfragmented formation expanded toward such a void.

65. A method as recited in claim 63 wherein the zone has an average Fischer assay more than 20 gallons per ton and the ratio of spacing distance to burden distance is less than about $\frac{2}{3}$.

66. A method as recited in claim 63 wherein the explosive charges extend between about the middle of the zone of unfragmented formation and the boundary of the zone of unfragmented formation remote from the void.

67. A method for forming an in situ oil shale retort in a subterranean formation containing oil shale, the in situ oil shale retort containing a fragmented permeable mass of formation particles comprising the steps of:

excavating at least one void within the boundaries of the in situ oil shale retort site and leaving a zone of unfragmented formation above the void having a horizontally extending free face over the void;

drilling a plurality of blasting holes in the zone of unfragmented formation;

loading explosive charges in such blasting holes for forming an array of explosive charges having a ratio of spacing distance to burden distance sufficiently small that said explosive charges can interact and fragment formation substantially to a plane at the portion of such charges remote from such void, and having an array scaled depth of burial above about the maximum of the apparent crater curve and up to about the maximum of the true crater curve for the formation; and detonating such explosive charges for explosively expanding such zone of unfragmented formation toward the void for forming a fragmented permeable mass of formation particles in the retort.

68. A method as recited in claim 67 wherein the void is a limited void relative to the zone of unfragmented formation expanded toward such a void.

69. A method as recited in claim 67 wherein the zone of unfragmented formation has an average Fischer assay more than 20 gallons per ton and the scaled depth of burial of the array is in the range of from about 6 to 9 mm/cal$^{1/3}$.

70. A method as recited in claim 67 wherein the scaled depth of burial of the array is in the range of from about 6 to 9 mm/cal$^{1/3}$ for rich oil shale and in the range of from about 9 to 12 mm/cal$^{1/3}$ for lean oil shale.

71. A method for forming a fragmented permeable mass of formation particles in a subterranean formation comprising the steps of:

excavating at least one void within the boundaries of the fragmented mass being formed and leaving a zone of unfragmented formation above and below the void for explosive expansion toward the void, the void being a limited void relative to the volume of the zone of unfragmented formation to be explosively expanded toward the void and having a horizontally extending free face adjacent the void;

drilling a plurality of blasting holes perpendicular to the free face into at least one such zone of unfragmented formation;

loading explosive in such blasting holes for forming an array of columnar explosive charges having a ratio of spacing distance to burden distance less than about one, and sufficient explosive in each blasting hole to fragment formation substantially to a plane at the ends of such columnar charges remote from the free face, and an array scaled depth of burial in the range of from about 6 to 12 $mm/cal^{1/3}$; and detonating such explosive charges for explosively expanding the zone of unfragmented formation toward the void for forming a fragmented permeable mass of formation particles in the retort.

72. A method as recited in claim 71 wherein the scaled depth of burial of the array is in the mounding region of the cratering curve for the subterranean formation.

73. A method as recited in claim 71 wherein the explosive charges extend between about the middle of the zone of unfragmented formation and the boundary of the zone of unfragmented formation remote from the void.

74. A method as recited in claim 71 wherein the zone of unfragmented formation is above the void and is explosively expanded downwardly towards the void.

75. A method as recited in claim 71 wherein the scaled depth of burial of the array is in the deep cratering region of the cratering curve for the subterranean formation.

* * * * *

UNITED STATES PATENT AND TRADEMARK OFFICE

CERTIFICATE OF CORRECTION

PATENT NO. : 4,336,966

DATED : June 29, 1982

INVENTOR(S) : Thomas E. Ricketts

It is certified that error appears in the above–identified patent and that said Letters Patent are hereby corrected as shown below:

Column 2, line 23, "discloses" should be -- disclose --.
Column 3, line 60, -- oil -- should be inserted after "situ" and before "shale".
Column 5, line 63, "as" should be -- an --.
Column 6, line 56, "≃" should be -- 7/8 --.
Column 8, line 20, "l" should be -- ℓ --.
Column 8, line 29, equation should be -- $DOB_{pl} = sdob_{pt}^{3} \cdot (w/s^{2})$ --
Column 8, line 35, "]DOB" should be -- [DOB --.
Column 8, line 49, "]W" should be -- [W --.
Column 10, line 43, "mounting" should be -- mounding --.
Column 10, line 56, "volumes" should be -- values --.
Column 12, line 12, "exanding" should be -- expanding --.

Signed and Sealed this

*Twenty-sixth* Day of *October 1982*

[SEAL]

*Attest:*

GERALD J. MOSSINGHOFF

*Attesting Officer*

*Commissioner of Patents and Trademarks*